US011054782B2

(12) United States Patent
Shimoda

(10) Patent No.: US 11,054,782 B2
(45) Date of Patent: Jul. 6, 2021

(54) IMAGE FORMING APPARATUS FOR DETERMINING SENSOR INSTALLATION TILT ANGLE, METHOD OF CONTROLLING IMAGE FORMING APPARATUS, AND NON-TRANSITORY RECORDING MEDIUM

(71) Applicant: Junichi Shimoda, Tokyo (JP)

(72) Inventor: Junichi Shimoda, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/010,243

(22) Filed: Sep. 2, 2020

(65) Prior Publication Data

US 2021/0088955 A1 Mar. 25, 2021

(30) Foreign Application Priority Data

Sep. 25, 2019 (JP) ..... JP2019-174089

(51) Int. Cl.
*G03G 15/00* (2006.01)

(52) U.S. Cl.
CPC ..... *G03G 15/5041* (2013.01); *G03G 15/5058* (2013.01); *G03G 2215/00042* (2013.01); *G03G 2215/00059* (2013.01)

(58) Field of Classification Search
CPC ..... G03G 15/5041; G03G 15/5058; G03G 2215/00042; G03G 2215/00059
USPC ..... 399/49, 301
See application file for complete search history.

(56) References Cited

U.S. PATENT DOCUMENTS 5,630,195 A * 5/1997 Sawayama ..... G03G 15/0855 399/49
8,910,574 B2 * 12/2014 Gouda ..... G01N 21/86 101/485
2005/0147424 A1 7/2005 Kato et al.
2011/0318065 A1 12/2011 Shimoda
2015/0323882 A1 * 11/2015 Fukuhara ..... G03G 15/5058 399/74

(Continued)

FOREIGN PATENT DOCUMENTS

JP 2005-031227 A 2/2005
JP 2007-025315 A 2/2007

(Continued)

*Primary Examiner* — Robert B Beatty
(74) *Attorney, Agent, or Firm* — Harness, Dickey & Pierce, P.L.C.

(57) ABSTRACT

An image forming apparatus includes an image forming device forming an image, a transfer belt having an image bearing surface on which the image moves to first and second regions, a sensor installed at an installation angle to the image bearing surface and including a light emitting element emitting light, a first and second light receiving elements receiving light reflected from the first and second regions, respectively, circuitry to generate first and second information according to light entered the first and second light receiving elements, respectively, generate, when the image moves, time information according to a difference between first and second times at each of which the first and second information, respectively, reach a threshold, obtain a tilt table based on the time difference information, and determine, by the tilt table, tilt information corresponding to the time information and indicating a difference between the installation angle and a reference angle.

6 Claims, 11 Drawing Sheets

(56) References Cited

U.S. PATENT DOCUMENTS

| | | | | |
|---|---|---|---|---|
| 2019/0286035 | A1 | 9/2019 | Kemmochi et al. | |
| 2019/0369538 | A1* | 12/2019 | Ishizuka | G03G 15/5041 |

FOREIGN PATENT DOCUMENTS

| | | | | | |
|---|---|---|---|---|---|
| JP | 2016148521 | A | * | 8/2016 | |
| JP | 2018017937 | A | * | 2/2018 | B41J 2/471 |

* cited by examiner

T1 — T2 = A > 0

T1 — T2 = A < 0

FIG. 7A

| TIME DIFFERENCE INFORMATION (T1−T2=A) | TILT INFOR-MATION | REMARKS |
|---|---|---|
| $0 \leq A < 2.95$ | 0 | $\theta \approx 0°$ : T1≈52.2ms T2≈50ms A ≈ 2.2 |
| $2.95 \leq A < 4.45$ | 1 | $\theta \approx 1°$ : T1≈53.7ms T2≈50ms A ≈ 3.7 |
| $4.45 \leq A < 5.95$ | 2 | $\theta \approx 2°$ : T1≈55.2ms T2≈50ms A ≈ 5.2 |
| $5.95 \leq A < 7.45$ | 3 | $\theta \approx 3°$ : T1≈56.8ms T2≈50ms A ≈ 6.7 |
| $7.45 \leq A < 8.95$ | 4 | $\theta \approx 4°$ : T1≈58.3ms T2≈50ms A ≈ 8.2 |
| $8.95 \leq A < 10.45$ | 5 | $\theta \approx 5°$ : T1≈59.8ms T2≈50ms A ≈ 9.7 |

FIG. 7B

| TIME DIFFERENCE INFORMATION (T1−T2=A) | TILT INFOR-MATION | REMARKS |
|---|---|---|
| 0 > A ≥ −2.95 | 0 | θ ≈ 0° : T1≈50ms T2≈52.2ms A ≈ −2.2 |
| −2.95 ≥ A > −4.45 | −1 | θ ≈ −1° : T1≈50ms T2≈53.7ms A ≈ −3.7 |
| −4.45 ≥ A > −5.95 | −2 | θ ≈ −2° : T1≈50ms T2≈55.2ms A ≈ −5.2 |
| −5.95 ≥ A > −7.45 | −3 | θ ≈ −3° : T1≈50ms T2≈56.8ms A ≈ −6.7 |
| −7.45 ≥ A > −8.95 | −4 | θ ≈ −4° : T1≈50ms T2≈58.3ms A ≈ −8.2 |
| −8.95 ≥ A > −10.45 | −5 | θ ≈ −5° : T1≈50ms T2≈59.8ms A ≈ −9.7 |

IMAGE FORMING APPARATUS FOR DETERMINING SENSOR INSTALLATION TILT ANGLE, METHOD OF CONTROLLING IMAGE FORMING APPARATUS, AND NON-TRANSITORY RECORDING MEDIUM

CROSS-REFERENCE TO RELATED APPLICATION

This patent application is based on and claims priority pursuant to 35 U.S.C. § 119(a) to Japanese Patent Application No. 2019-174089, filed on Sep. 25, 2019, in the Japan Patent Office, the entire disclosure of which is hereby incorporated by reference herein.

BACKGROUND

Technical Field

Embodiments of the present disclosure relate to an image forming apparatus, a method of controlling an image forming apparatus, and a non-transitory recording medium storing instructions for executing a method of controlling an image forming apparatus.

Related Art

Conventionally, in order to correct a start position of forming an image, techniques of forming a specific image on an image bearing surface has been adopted. (hereinafter, the correction may be referred to as position correction). For example, techniques of detecting a specific image formed on an image bearing surface by a sensor unit have been used. With the above configuration, the positional deviation correction is executed according to detected information generated when the sensor unit detects the specific image.

In order to execute the positional deviation correction with high accuracy, a sensor is required to be installed at a predetermined reference angle with respect to an image bearing surface (installation angle=reference angle). If the installation angle of the sensor is different from the reference angle, operation of adjusting the installation angle to the reference angle (hereinafter, simply referred to as "adjustment") is required.

SUMMARY

An exemplary embodiment of the present disclosure includes an image forming apparatus. The image forming apparatus includes an image forming device, a transfer belt, a sensor, and circuitry. The image forming device forms various images including a specific image. The transfer belt has an image bearing surface on which the specific image is formed. The transfer belt moves the specific image to a first detection region and a second detection region on the image bearing surface. The sensor is installed at an installation angle with respect to the image bearing surface. The sensor includes a light emitting element, a first light receiving element, and a second light receiving element. The light emitting element emits detected light to the image bearing surface. The first light receiving element receives a first part of the detected light that is reflected from the first detection region. The second light receiving element receives a second part of the detected light that is reflected from the second detection region. The circuitry generates detected information. The detected information includes first detected information generated according to a quantity of light entered the first light receiving element and second detected information generated according to a quantity of light entered the second light receiving element. The circuitry generates, when the specific image on the image bearing surface moves, time difference information according to a difference between a first time point and a second time point. The first time point is a time at which the first detected information reaches a threshold value and the second time point is a time at which the second detected information reaches the threshold value. The circuitry obtains, from a memory, one of a plurality of tilt information tables. The one of the plurality of tilt information is determined based on the time difference information that is generated. Each tilt information associates tilt information, indicating a difference between the installation angle and a reference angle, with time difference information. The circuitry determines tilt information corresponding to the time difference information that is generated, using the one of the plurality of tilt information tables that is obtained.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 7A and FIG. 7B are conceptual diagrams each illustrating a tilt information table, according to one of the embodiments;

Figure 1:
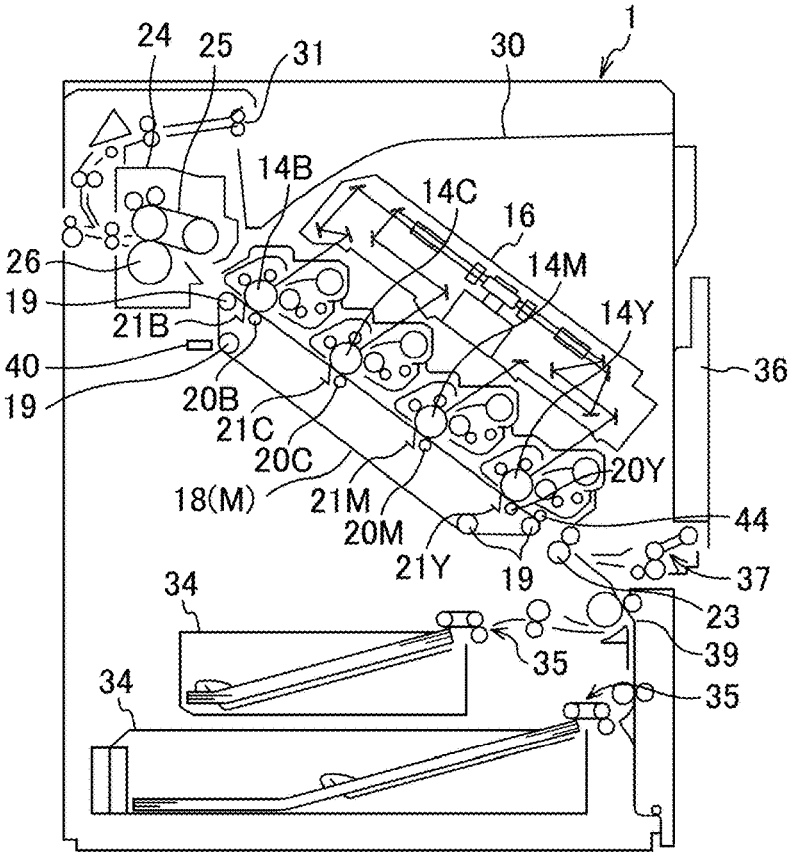
FIG. 1 is a block diagram illustrating a schematic configuration of a multifunction peripheral product (MFP) as an example of an image forming apparatus, according to one of the embodiments.

The accompanying drawings are intended to depict example embodiments of the present disclosure and should not be interpreted to limit the scope thereof. The accompanying drawings are not to be considered as drawn to scale unless explicitly noted.

DETAILED DESCRIPTION

The terminology used herein is for describing particular embodiments only and is not intended to be limiting of the present disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operation in a similar manner, and achieve a similar result.

First Embodiment

Several exemplary embodiments of the present disclosure are described hereinafter with reference to drawings. FIG. 1 is a diagram illustrating a multifunction peripheral, a multifunction product, or a multifunction printer (MFP) 1 as an example of an information processing apparatus.

As illustrated in FIG. 1, the MFP 1 includes a manual feeding tray 36 and a sheet feeding tray 34. A print sheet, which is an example of a recording medium, fed from the manual feeding tray 36 is directly conveyed to a registration roller 23 by a sheet feeding roller 37. On the other hand, a print sheet fed from the sheet feeding tray 34 is conveyed by a sheet feeding roller 35 to the registration roller 23 by an intermediate roller 39.

The MFP 1 includes photoconductor drums 14B, 14C, 14M, and 14Y. Hereinafter, one or more of the photoconductor drums 14B, 14C, 14M, and 14Y may be collectively referred to as the photoconductor drum 14 or the photoconductor drums 14. As illustrated in FIG. 1, the photoconductor drum 14 includes the photoconductor drum 14B on which a black image is formed, the photoconductor drum 14C on which a cyan image is formed, the photoconductor drum 14M on which a magenta image is formed, and the photoconductor drum 14Y on which a yellow image is formed. When each of the photoconductor drums 14B, 14C, 14M, or 14Y is irradiated by a writing unit 16, an electrostatic latent image that corresponds to an image to be printed is formed.

The print sheet conveyed to the registration roller 23 is conveyed to a transfer belt 18 (image carrier) at a time when the electrostatic latent image formed on the photoconductor drum 14 coincides with a leading edge of the print sheet. The print sheet conveyed to the transfer belt 18 passes through a sheet attracting nip formed by the transfer belt 18 and a sheet attracting roller 44. When the print sheet passes through the sheet attracting nip, the print sheet is attracted to the transfer belt 18 by a bias applied to the sheet attracting roller 44. The print sheet is conveyed at, for example, about 125 mm/sec.

As illustrated in FIG. 1, the MFP 1 includes a plurality of transfer brushes 21B, 21C, 21M, and 21Y. Hereinafter, the plurality of transfer brushes 21B, 21C, 21M, and 21Y may be collectively referred to as the transfer brushes 21 or transfer brush 21. Each of the transfer brushes 21 faces the corresponding photoconductor drum 14 via the transfer belt 18. To each transfer brush 21, a transfer bias (plus) opposite in polarity (minus) to the toner is applied.

As illustrated in FIG. 1, the MFP 1 includes a plurality of pressure rollers 20B, 20C, 20M, and 20Y. Hereinafter, the plurality of pressure rollers 20B, 20C, 20M, and 20Y may be collectively referred to as the pressure rollers 20 or pressure roller 20. The pressure roller 20 holds the transfer belt 18 against the photoconductor drum 14 at a predetermined pressure. The image on each photoconductor drum 14 is transferred to an image bearing surface M of the transfer belt 18 by the transfer brush 21 corresponding to each photoconductor drum 14. In the present embodiment, the images of the respective colors formed on the respective photoconductor drums 14 are transferred onto the print sheet in the order of yellow, black, cyan, and magenta.

The print sheet on which the image of each of the photoconductor drums 14 is transferred is separated by self stripping from the transfer belt 18 by a drive roller 19 and conveyed to a fixing unit 24. As illustrated in FIG. 1, the fixing unit 24 includes a fixing belt 25 and a pressure roller 26. When the print sheet passes through the fixing unit 24, the image transferred to the print sheet is fixed. After passing through the fixing unit 24, the print sheet is discharged from a sheet ejection roller 31 to a face down (FD) tray 30.

As illustrated in FIG. 1, the MFP 1 includes a photosensor 40. Specifically, the photosensor 40 is provided so as to face the image bearing surface M of the transfer belt 18. Light reflected from the image bearing surface M enters the photosensor 40. According to a quantity of light entering the photosensor 40, information D is generated. Hereinafter the information D is referred to as detected information D. The detected information D indicates magnitude of a voltage generated according to the quantity of light entering the photosensor 40. Any suitable sensor other than a photosensor may be replaceable with the photosensor 40 in the embodiment. Specifically, such a sensor includes a light emitting element that emits detected light to the image bearing surface M, a light receiving element to which the detected light reflected from a detection region enters, and a light receiving element to which the detected light reflected from another detection region enters. In addition, such a sensor faces the image bearing surface M at an installation angle.

The MFP 1 may shift a mode to a position correction mode, a density correction mode, or a tilt correction mode. Hereinafter, the position correction mode, the density correction mode, and the tilt correction mode may be collectively referred to as a "correction mode". In the correction mode, a correction pattern P (specific image) is formed on the image bearing surface M (see FIG. 2A described later). In addition, in the correction mode, the correction pattern P moves to a position detected by the photosensor 40. When the correction pattern P is detected by the photosensor 40, the detected information D changes (see FIG. 5B described later).

In the position correction mode, positional deviation is corrected based on the detected information D. Hereinafter, a correction of the positional deviation is simply referred to as a "position correction". In the density correction mode, density of an image formed on the image bearing surface M is corrected based on the detected information D. Hereinafter, a correction of the density is simply referred to as a "density correction".

In order to execute the position correction and the density correction with high accuracy, the photosensor 40 is to be installed at a predetermined reference angle with respect to the image bearing surface M. The reference angle in the embodiment is, for example, approximately 90 degrees (see FIG. 2B described later). Hereinafter, in order to distinguish from the reference angle (ideal angle), an actual angle of the photosensor 40 with respect to the image bearing surface M is referred to as an "installation angle".

For example, if the installation angle of the photosensor 40 is different from the reference angle, adjustment is required to adjust the installation angle to the reference angle. However, a difference between the installation angle and the reference angle may not be visually determined.

In consideration of the above described situation, in the present embodiment, a difference between the installation angle and the reference angle is to be determined as tilt information B, and the tilt information B may be notified to a user. The tilt information B is determined in the tilt correction mode. According to the present embodiment, the difference between the installation angle and the reference angle is easily detected.

Figure 2A:
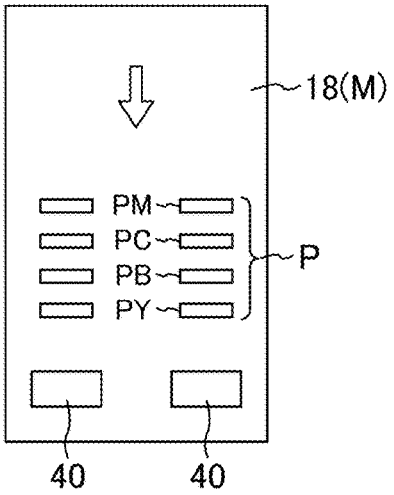
FIG. 2A is a diagram illustrating a correction pattern, according to one of the embodiments.

FIG. 2A is a diagram illustrating a correction pattern P (Y, B, C, M), according to one of the embodiments. An arrow illustrated in FIG. 2A indicates a direction in which an image formed on the image bearing surface M moves. The direction is, hereinafter, simply referred to as a "movement direction"). In FIG. 2A, a scale of each configuration is appropriately changed to be illustrated for descriptive purposes.

As described above, the correction pattern P is formed on the image bearing surface M in the correction mode. The correction pattern P formed on the image bearing surface M moves in the movement direction at a predetermined specific speed (for example, about 125 mm/sec). As illustrated in FIG. 2A, the correction pattern P is formed on both of a left end side and a right end side of the transfer belt 18 as viewed in the movement direction. According to the present embodiment, each of the two photosensors 40 detects the correction pattern P.

As illustrated in FIG. 2A, the correction pattern P includes a yellow image PY, a black image PB, a cyan image PC, and a magenta image PM, which are formed by the photoconductor drum 14Y, the photoconductor drum 14B, the photoconductor drum 14C, and the photoconductor drum 14M, respectively. Each image of the correction pattern P is, for example, a substantially rectangular elongated image, and a long side of each image is formed substantially perpendicular to the movement direction. The correction pattern P is not limited to the above-described example. For example, the long side of each image of the correction pattern P may be inclined with respect to the movement direction.

Each image of the correction pattern P is formed along the movement direction in an order of the yellow image PY, the black image PB, the cyan image PC, and the magenta image PM as viewed from the photosensor 40. In the configuration described above, when the correction pattern P moves, with movement of the transfer belt 18, in the movement direction, the yellow image PY of the images of the correction pattern P is detected by the photosensor 40 at first. Then, the photosensor 40 detects the other images in an order of the black image PB, the cyan image PC, and the magenta image PM. When the photosensor 40 detects the correction pattern P, a size of the above-described detected information D changes (see FIG. 5B described later).

Figure 2B:
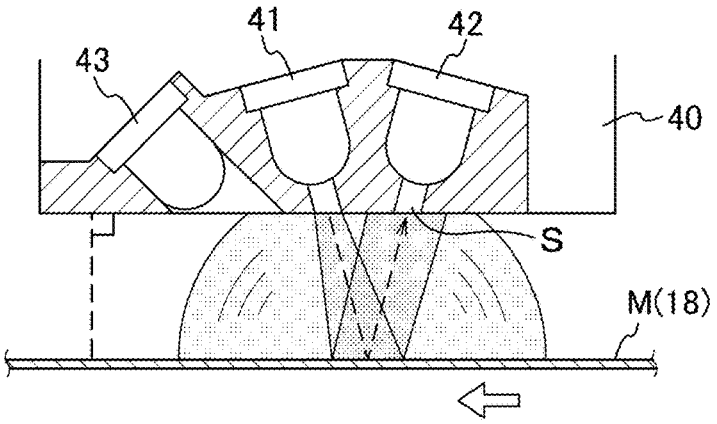
FIG. 2B is a diagram illustrating a detailed configuration of a photosensor, according to one of the embodiments.

FIG. 2B is a diagram illustrating a detailed configuration of the photosensor 40 according to the present embodiment. Note that FIG. 2B illustrates a cross-sectional view of the photosensor 40 and a part of the transfer belt 18 (image bearing surface M). In FIG. 2B, the movement direction in which the image (correction pattern P) formed on the image bearing surface M moves is indicated by an arrow.

As illustrated in FIG. 2B, the photosensor 40 includes photoelectric elements. The photoelectric elements include a light emitting element 41 and light receiving elements that are a first light receiving element 42 and a second light receiving element 43. Hereinafter, the first light receiving element 42 and the second light receiving element 43 may be collectively referred to as the light receiving elements or the light receiving element. The photoelectric elements of the photosensor 40 are arranged in a line in the movement direction in an order of the first light receiving element 42, the light emitting element 41, and the second light receiving element 43, as illustrated in FIG. 2B. In addition, the photosensor 40 includes a slit S. Light emitted from the light emitting element 41 is reflected from the image bearing surface M and enters the light receiving element through the slit S.

As illustrated in FIG. 2B, the light receiving elements included in the photosensor 40 includes the first light receiving element 42 and the second light receiving element 43. It is assumed that the photosensor 40 is installed at the reference angle (approximately 90 degrees) with respect to the image bearing surface M. In the configuration described above, the light that is emitted from the light emitting element 41 and that is secularly reflected from the image bearing surface M or the image formed on the image bearing surface M enters the first light receiving element 42. On the other hand, the light that is emitted from the light emitting element 41 and that is diffused and reflected by the image bearing surface M or the image formed on the image bearing surface M enters the second light receiving element 43.

When the light enters the light receiving element, the detected information D, which is first detected information D1 or second detected information D2, is generated according to the quantity of light. Specifically, the first detected information D1 is generated according to the quantity of light entering the first light receiving element 42. In addition, the second detected information D2 is generated according to the quantity of light entering the second light receiving element 43.

In the configuration of the present embodiment described above, the first light receiving element 42 is provided for the position correction. In addition, the second light receiving element 43 is provided for the density correction. Both the first light receiving element 42 and the second light receiving element 43 are used when the tilt information B is determined. A detailed description is given below.

Figure 3:
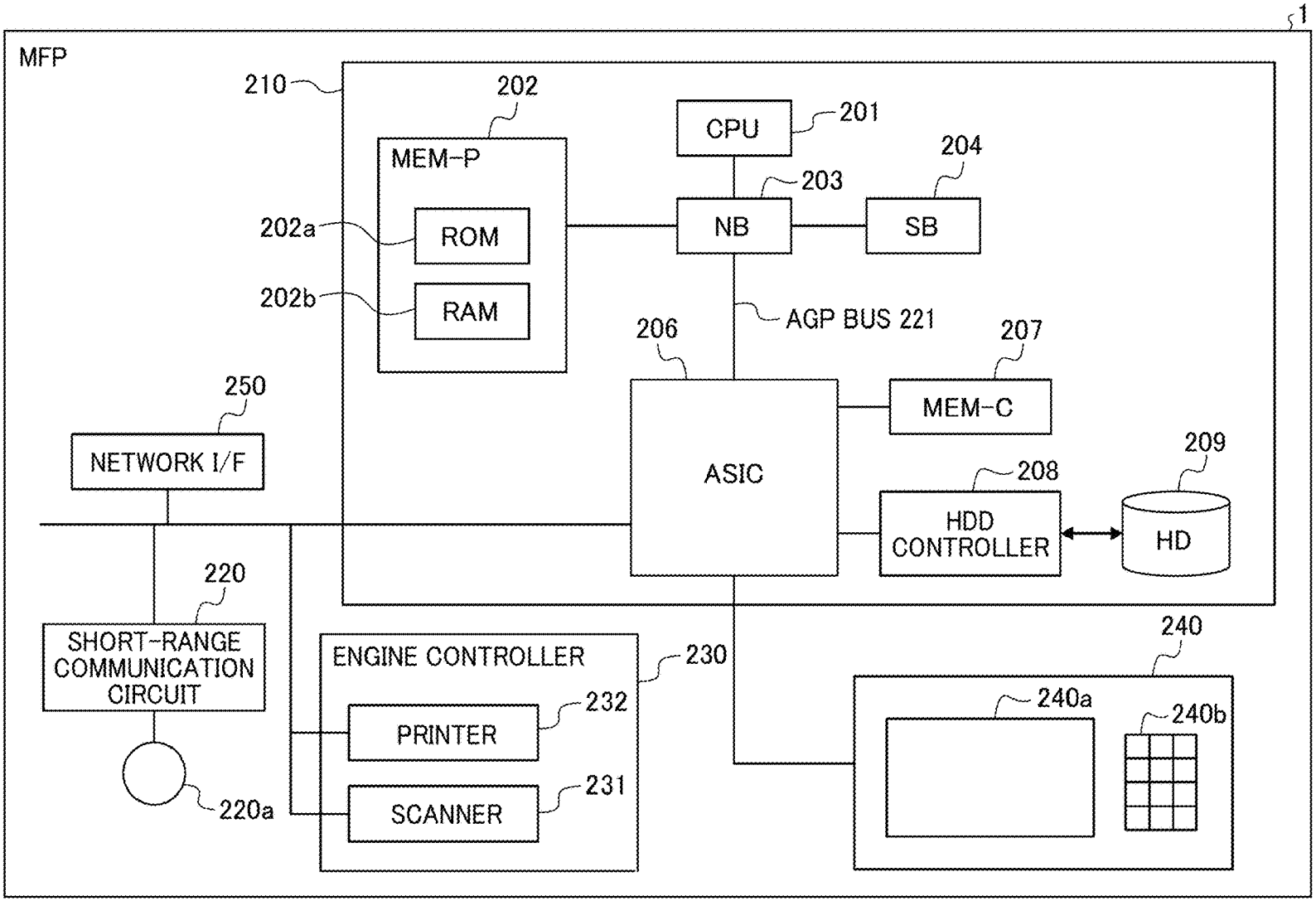
FIG. 3 is a schematic block diagram illustrating a hardware configuration of an MFP, according to one of the embodiments.

FIG. 3 is a diagram illustrating a hardware configuration of the MFP 1 according to an embodiment. As illustrated in FIG. 3, the MFP 1 includes a controller 210, a short-range communication circuit 220, an engine controller 230, a control panel 240, and a network interface (I/F) 250.

The controller 210 includes a central processing unit (CPU) 201 as a main processor, a system memory (MEM-P) 202, a north bridge (NB) 203, a south bridge (SB) 204, an Application Specific Integrated Circuit (ASIC) 206, a local memory (MEM-C) 207 as a storage unit, a hard disk drive (HDD) controller 208, and a hard disk (HD) 209 as a storage unit. The NB 203 and the ASIC 206 are connected through an Accelerated Graphics Port (AGP) bus 221.

The CPU 201 is a processor that performs overall control of the MFP 1. The NB 203 is a bridge for connecting the CPU 201, the MEM-P 202, the SB 204, and the AGP bus 221. The NB 203 includes a memory controller that controls reading/writing of the MEM-P 202, a peripheral component interconnect (PCI) master, and an AGP target.

The MEM-P 202 includes a read only memory (ROM) 202*a* that stores programs and data for implementing various functions of the controller 210. The MEM-P 202 further includes a random access memory (RAM) 202*b* that deploys the programs and data, or as a drawing memory that stores drawing data for printing. The program stored in the ROM 202*a* may be stored in any computer-readable storage medium, such as a compact disc-read only memory (CD- ROM), compact disc-recordable (CD-R), or digital versatile disc (DVD), in a file format installable or executable by the computer, for distribution.

The SB 204 is a bridge to connect the NB 203 to a PCI device and a peripheral device. The ASIC 206 is an integrated circuit (IC) dedicated to an image processing use, and connects the AGP bus 221, the PCI bus 222, the HDD 208, and the MEM-C 207 to each other.

The ASIC 206 includes a PCI target, an AGP master, an arbiter (ARB) as a central processor of the ASIC 206, a memory controller for controlling the MEM-C 207, a plurality of direct memory access controllers (DMACs) capable of converting coordinates of image data with a hardware logic, and a PCI unit that transfers data between a scanner 231 and a printer 232 through the PCI bus 222. A universal serial bus (USB) interface or an Institute of Electrical and Electronics Engineers 1394 (IEEE 1394) interface may be connected to the ASIC 206.

The MEM-C 207 is a local memory, which is used as a buffer for image data to be printed or code image. The HD 209 stores various image data, font data for printing, and form data. The HD 209 reads or writes data from or to the HD 209 under the control of the CPU 201. The AGP bus 221 is a bus interface for a graphics accelerator card, which has been proposed to accelerate graphics processing. Through directly accessing the MEM-P 202 by high-throughput, speed of the graphics accelerator card is improved.

The short-range communication circuit 220 includes a short-range communication antenna 220*a*. The short-range communication circuit 220 is a communication circuit that communicates in compliance with the near field communication (NFC), the Bluetooth (registered trademark) or the like. The engine controller 230 includes the scanner 231 and the printer 232 and forms images. The control panel 240 includes a panel display 240*a* and operation panel 240*b*. The panel display 240*a* is implemented by, for example, a touch panel that displays current settings or a selection screen and receives a user input. The operation panel 240*b* includes a numeric keypad that receives set values of various image forming parameters such as image density parameter and a start key that accepts an instruction for starting copying.

The controller 210 controls all operations of the MFP 1. For example, the controller 210 controls drawing, communication, or user inputs to the control panel 240. The scanner 231 or the printer 232 includes an image processing unit such as error diffusion or gamma conversion.

In response to an instruction to select a specific application through the control panel 240, for example, using a mode switch key, the MFP 1 selectively performs a document box function, a copy function, a print function, and a facsimile function. When the document box function is selected, the MFP 1 operates in a document box mode to store document data. With selection of the copy function, the MFP 1 operates in a copy mode. With selection of the print function, the MFP 1 operates in a print mode. With selection of the facsimile function, the MFP 1 operates in a facsimile mode.

The network I/F 250 is an interface to perform data communication using the communication network. The short-range communication circuit 220 and the network I/F 250 are electrically connected to the ASIC 206 through the PCI bus 222.

Figure 4:
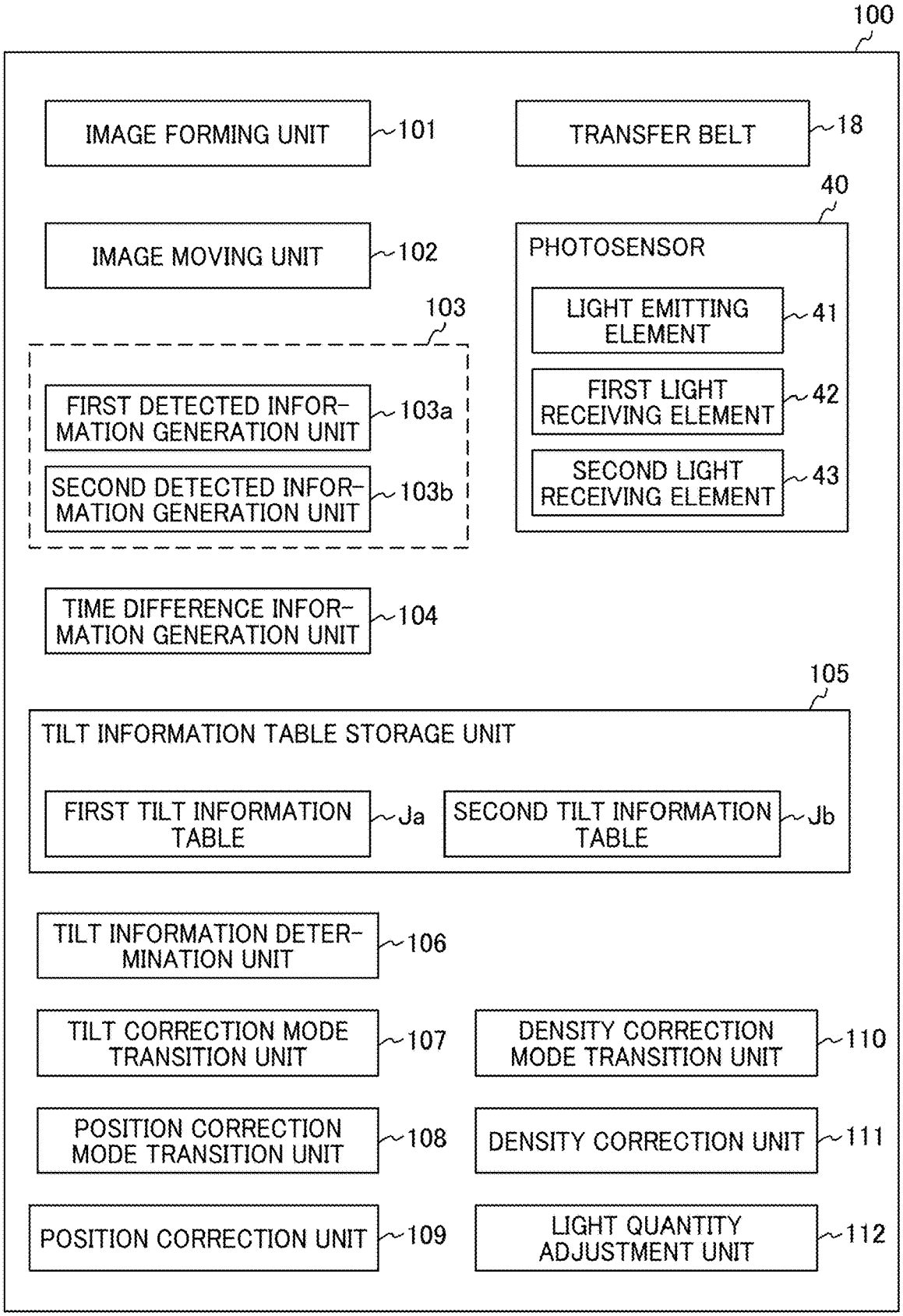
FIG. 4 is a functional block diagram illustrating an MFP, according to one of the embodiments.

FIG. 4 is a functional block diagram illustrating the image forming apparatus 100 (MFP 1) according to an embodiment. As illustrated in FIG. 4, the image forming apparatus 100 includes an image forming unit 101, an image moving unit 102, a detected information generation unit 103 including a first detected information generation unit 103*a* and a second detected information generation unit 103*b*, a time difference information generation unit 104, a tilt information table storage unit 105, a tilt information determination unit 106, a tilt correction mode transition unit 107, a position correction mode transition unit 108, a position correction unit 109, a density correction mode transition unit 110, a density correction unit 111, and a light quantity adjustment unit 112. Each of the functional units of the MFP 100 is implemented by the CPU 201 executing the program. The image forming apparatus 100 also includes the transfer belt 18 that functions as an image bearing unit and the photosensor 40 that functions as a sensor unit.

The image forming unit 101 forms various images on the image bearing surface M. For example, an image corresponding to the above-mentioned image data is formed on the image bearing surface M. The image formed on the image bearing surface is transferred onto a print sheet as described above. In addition, when shifting a mode to the correction mode (position correction mode, density correction mode, or tilt correction mode), the image forming unit 101 forms the correction pattern P on the image bearing surface M (see FIG. 2A).

The image moving unit 102 moves the correction pattern P at the predetermined specific speed in the correction mode. More specifically, the image moving unit 102 moves the correction pattern P to a region (detection region) where the image is detectable by the photosensor 40.

The detected information generation unit 103 generates the detected information D according to the quantity of light entering the light receiving elements (42, 43) of the photosensor 40 in the correction mode. Specifically, the detected information generation unit 103 includes the first detected information generation unit 103*a* and the second detected information generation unit 103*b*. The first detected information generation unit 103*a* generates the first detected information D1 according to the quantity of light entering the first light receiving element 42 of the photosensor 40. The second detected information generation unit 103*b* generates second detected information D2 according to the quantity of light entering the second light receiving element 43 of the photosensor 40.

The time difference information generation unit 104 generates time difference information A in the tilt correction mode. The time difference information A is a numerical value that identifies a time difference between a time point at which the first detected information D1 reaches a threshold value (threshold value Vt), hereinafter referred to as a "first time point t1", and another time point at which the second detected information D2 reaches the threshold value (threshold value Vt), hereinafter referred to as a "second time point t2, under a condition where the correction pattern P moves to the detection region where the image is detected by the photosensor 40 in the specific speed (see FIG. 5B described later). The threshold value is set in advance. A more detailed description of the time difference information A is given below.

The time difference information A changes according to the installation angle of the photosensor 40 with respect to the image bearing surface M. That is, when the installation angle of the photosensor 40 is not same as the reference angle, the time difference information A is different from the one in a case where the installation angle is same as the reference angle. Specifically, the larger a difference between the installation angle and the reference angle is (the larger the tilt is), the larger the time difference information A becomes. Based on the time difference information a, the difference between the installation angle and the reference angle is identifiable (to be estimated).

The tilt information table storage unit 105 stores a plurality of time difference information tables (Ja, Jb) in advance. As described above, based on the time difference information A, the difference between the installation angle of the photosensor 40 and the reference angle is specified. The tilt information table associates each of a plurality of pieces of time difference information A with corresponding one of a plurality of pieces of tilt information B (see FIG. 7 described later). The tilt information B corresponding to the time difference information A indicates the difference between the installation angle and the reference angle. The difference is estimated based on the time difference information A.

When the time difference information A is generated, the tilt information determination unit 106 determines the tilt information B corresponding to the time difference information A based on the tilt information table. According to the embodiment, the tilt information B determined by the tilt information determination unit 106 is notified. For example, the tilt information B determined by the tilt information determination unit 106 is displayed on the panel display 240*a*.

The embodiment described above allows a user to adjust the installation angle of the photosensor 40 by an angle indicated by the tilt information B displayed on the panel display 240*a* and change the current installation angle of the photosensor 40 to the reference angle. Notifying the tilt information B is not limited to the above-described example. For example, the image forming apparatus 100*a* may be connectable with a debug console and the display of the debug console may display the tilt information.

According to tilt (rotation) direction of the photosensor 40 (see FIGS. 6A and 6B described later), there are a case where the first time point t1 comes after the second time point t2 and another case where the first time point t1 comes before the second time point t2. A more detailed description is given below. The time difference information A is a positive numerical value when the first time point t1 is after the second time point t2, and is a negative numerical value when the first time point t1 is before the second time point t2.

The time difference information table according to the embodiment includes a first time difference information table Ja and a second time difference information table Jb. The tilt information determination unit 106 uses the first inclination information table Ja when the first time point t1 is after the second time point t2, and the second tilt information table Jb when the first time point t1 is before the second time point t2. That is, the time difference information table used by the tilt information determination unit 106 changes depending on whether the time difference information A is a positive numerical value or a negative numerical value.

The tilt correction mode transition unit 107 shifts a mode of the image forming apparatus 100 to the tilt correction mode. For example, when power is supplied to the image forming apparatus 100, the image forming apparatus 100 shifts to the tilt correction mode. However, the trigger for shifting to the tilt correction mode is not limited to the above-described example. For example, the mode transitions to the tilt correction mode in response to a user operation. In the tilt correction mode, the time difference information A described above is generated, and the tilt information B corresponding to the time difference information A is determined.

The position correction mode transition unit 108 shifts a mode of the image forming apparatus 100 to the position correction mode. Although detailed description is omitted, the position correction unit 109 corrects, in the position correction mode, the position at which the image forming unit 101 starts forming an image on the image bearing surface M based on the first detected information D1.

The density correction mode transition unit 110 shifts a mode of the image forming apparatus 100 to the density correction mode. Although detailed description is omitted, the density correction unit 111 corrects, in the density correction mode, the density of the image formed by the image forming unit 101 based on the second detected information D2. The trigger for shifting to the position correction mode and the trigger for shifting to the density correction mode are set appropriately. For example, the mode may be shifted to the position correction mode or the density correction mode immediately before the image is transferred onto the print sheet.

The light quantity adjustment unit 112 adjusts the quantity of light emitted from the light emitting element 41 of the photosensor 40. For example, the light quantity adjustment unit 112 adjusts, in the density correction mode, the quantity of light emitted from the light emitting element 41 to a size with which the density of the image formed on the image bearing surface M is correctable with high accuracy. A waveform of the second detected information D2 generated in the density correction mode described above is a sine wave.

If noise is superimposed on the second detected information D2, a determination that the second detected information D2 has reached the threshold voltage Vt, before a time point that is a time when the second detected information D2 originally is to reach the threshold voltage Vt may be made. In the above-described case, an error may occur at the second time point t2 (time difference information A), and the tilt information B may not be determined correctly.

In order to avoid the above-described situation in which the tilt information B may not be determined correctly, the light quantity adjustment unit 112 increases the quantity of light emitted from the light emitting element 41 in the tilt correction mode as compared with the quantity of light emitted from the light emitting element 41 in the density correction mode. Specifically, the light quantity adjustment unit 112 adjusts the quantity of light emitted from the light emitting element 41 in a manner that the second detected information D2 in the tilt correction mode becomes a rectangular wave.

Compared to when the second detected information D2 is a sine wave, when the second detected information D2 is a rectangular wave, a period of time from when the second detected information D2 starts increasing to when the second detected information D2 reaches the threshold voltage Vt is shorter. This prevents the second detected information D2 from being superimposed by noise during the period of time. The light quantity adjustment unit 112 according to the present embodiment may prevent a determination that the second detected information D2 reaches the threshold voltage Vt before the time when the second detected information D2 originally is to reach the threshold voltage Vt. Accordingly, the error at the second time point t2 (time difference information A) is prevented from occurring.

Figure 5A:
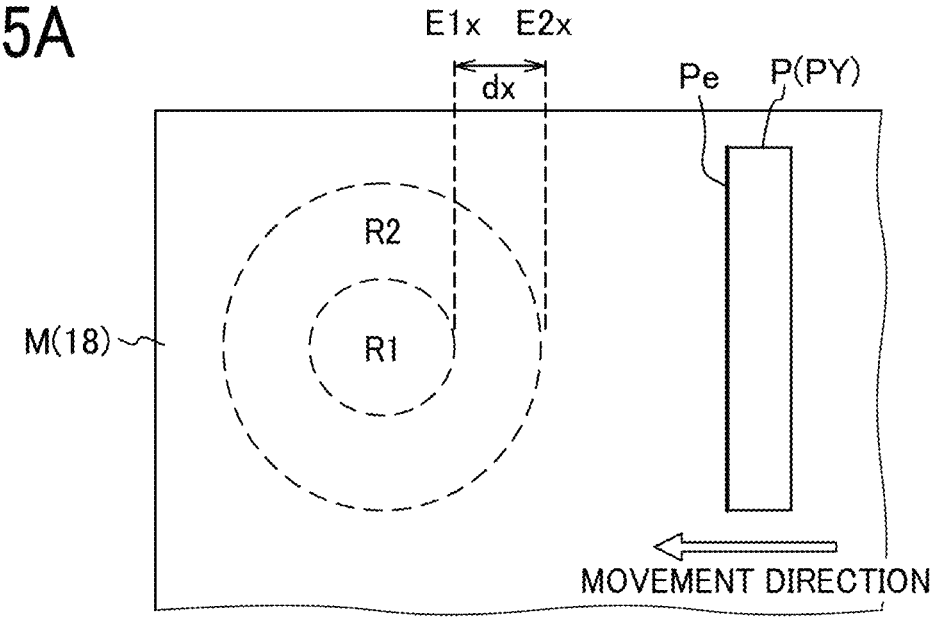
FIG. 5A and FIG. 5B are diagrams illustrating an example case in a tilt correction mode, according to one of the embodiments.
Figure 5B:
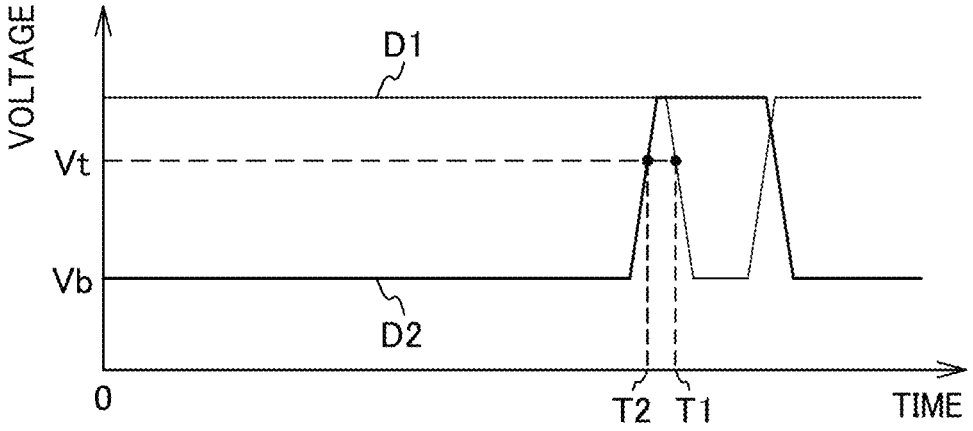

FIG. 5A and FIG. 5B are diagrams illustrating an example of the tilt correction mode, according to an embodiment. In the examples of FIG. 5A and FIG. 5B, the installation angle of the photosensor 40 is not shifted from the reference angle.

That is, the photosensor 40 is installed at approximately 90 degrees with respect to the image bearing surface M (see FIG. 2B described above).

In FIG. 5A, a part of the image bearing surface M in the tilt correction mode is illustrated. In addition, in FIG. 5A, an outer edge (field-of-view diameter) of a detection region R (1, 2) of the photosensor 40 is indicated by a broken line. As illustrated in FIG. 5A, the detection region R includes a first detection region R1 and a second detection region R2.

Light reflected by the first detection region R1 out of the light emitted from the light emitting element 41 of the photosensor 40 may enter the first light receiving element 42. That is, the first detection region R1 may be also referred to as a field-of-view diameter of the first light receiving element 42. On the other hand, light reflected by the second detection region R2 out of the light emitted from the light emitting element 41 of the photosensor 40 may enter the second light receiving element 43. That is, the first detection region R2 may be also referred to as a field-of-view diameter of the second light receiving element 43.

In the present embodiment, for ease of explanation, an end of the first detection region R1 on the opposite side to the movement direction is referred to as an end E1. In addition, the end E1 in a case where the photosensor 40 is installed at the reference angle may be referred to as an end E1*x*. Similarly, an end of the second detection region R2 on the side opposite to the movement direction is referred to as end E2. In addition, the end E2 in a case where the photosensor 40 is installed at the reference angle may be referred to as an end E2*x*. As illustrated in FIG. 5A, a distance between the end E1*x* and the end E2*x*, in the movement direction, is a distance dx.

In the tilt correction mode, the correction pattern P is formed on the image bearing surface M. In the example of FIG. 5A, the yellow image PY of the correction pattern P is illustrated as an example. The correction pattern P moves to the detection region R at the specific speed. Hereinafter, for ease of explanation, a portion of the correction pattern P that first reaches the detection region R (a long side of the yellow image PY, which is a movement direction side) may be referred to as an end portion Pe. In the present embodiment, a position of the end portion Pe on the image bearing surface M at a time when the correction pattern P starts moving is determined in advance. In addition, a timer counts time from when the correction pattern P starts moving.

FIG. 5B is a diagram illustrating change in time related to the first detected information D1 and the second detected information D2 in the tilt correction mode. In FIG. 5B, the magnitude (voltage) of the first detected information D1 and the magnitude (voltage) of the second detected information D2 at each time point after the correction pattern P starts moving are illustrated. In addition, the threshold voltage Vt is illustrated in FIG. 5B.

The quantity of light entering the first light receiving element 42 is substantially constant until a point in time when the correction pattern P (end portion Pe) is irradiated with the light from the light emitting element 41. That is, the first detected information D1 does not change until when the correction pattern P is irradiated with the light from the light emitting element 41. Similarly, the quantity of light entering the second light receiving element 43 is substantially constant until the correction pattern P is irradiated with the light from the light emitting element 41. That is, the second detected information D2 does not change until when the correction pattern P is irradiated with the light from the light emitting element 41. In the present embodiment, the second detected information D2 is substantially constant at the voltage Vb until the correction pattern P is irradiated with the light from the light emitting element 41.

When the correction pattern P is irradiated with the light from the light emitting element 41 after the correction pattern P starts moving, the light from the light emitting element 4 is diffused and reflected, and the voltage of the second detected information D2 starts increasing. Then the voltage of the second detected information D2 reaches the threshold voltage Vt. In the present embodiment, a period of time from a time when the movement of the correction pattern P starts to the second time point t2 at which the second detected information D2 reaches the threshold Vt, is referred to as a time T2.

After the correction pattern P starts moving, and when the light of the light emitting element 41 is diffusely reflected by the correction pattern P, the quantity of light entering the first light receiving element 42 reduces, and the voltage of the first detected information D1 reduces. Then, the first detected information D1 reaches the threshold voltage Vt. In the present embodiment, a period of time from a time when the movement of the correction pattern P starts to the first time point t1 at which the first detected information D1 reaches the threshold Vt, is referred to as a time T1.

The image forming apparatus 100 stores the time T1, which is a period of time to when the first detected information D1 reaches the threshold voltage Vt, and the time T2, which is a period of time to when the second detected information D2 reaches the threshold voltage Vt. In addition, the image forming apparatus 100 (time difference information generation unit 104) subtracts the time T2 from the time T1 and stores a result from the subtraction as the time difference information A (T1−T2=A).

As illustrated in FIG. 5B, in the photosensor 40 according to the present embodiment, when the installation angle is the reference angle, the time difference information A indicating the difference between the time T1, which is a period of time to when the first detected information D1 reaches the threshold voltage Vt, the time T2, which is a period of time to when the second detected information D2 reaches threshold voltage Vt, is in a numerical range of "$-2.95 \leq A < 2.95$".

Figure 6B:
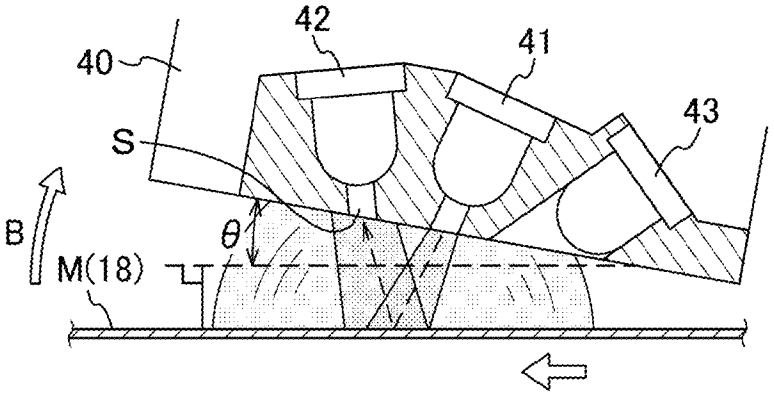
FIG. 6A to FIG. 6F are diagrams illustrating other example cases in a tilt correction mode, according to one of the embodiments.
Figure 6A:
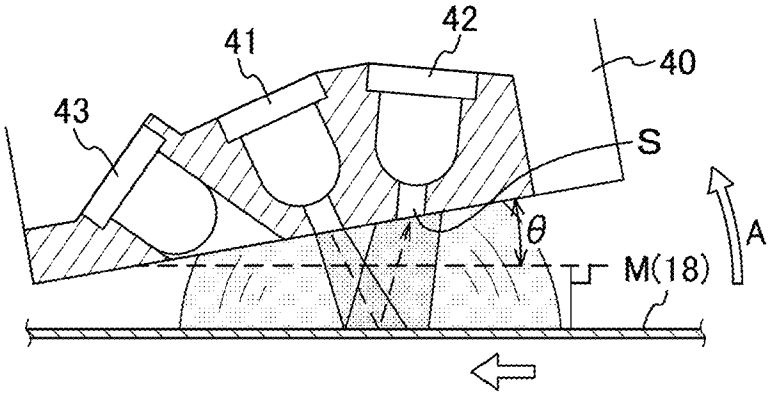

FIG. 6A is a diagram illustrating a case where the installation angle of the photosensor 40 is shifted from the reference angle, according to the present embodiment. In the present embodiment, for ease of explanation, the deviation of the installation angle from the reference angle may be referred to as "tilt θ" (degree). The image forming apparatus 100 (tilt information determination unit 106) determines the tilt information B indicating the tilt θ in the tilt correction mode.

FIG. 6A is a cross-sectional view illustrating the photosensor 40 when the photosensor 40 is cut in the movement direction, according to the present embodiment. In the example of FIG. 6A, the photosensor 40 is tilted by the tilt θ in a direction indicated by an arrow A (hereinafter referred to as a "first rotation direction"). When the photosensor 40 rotates in the first rotation direction from the reference angle, the time difference between a period of time to the first time point t1, at which the first detected information D1 reaches the threshold voltage Vt, and a period of time to the second time point t2, at which the second detected information D2 reaches the threshold voltage Vt increases. A more detailed description is given below.

Figure 6D:
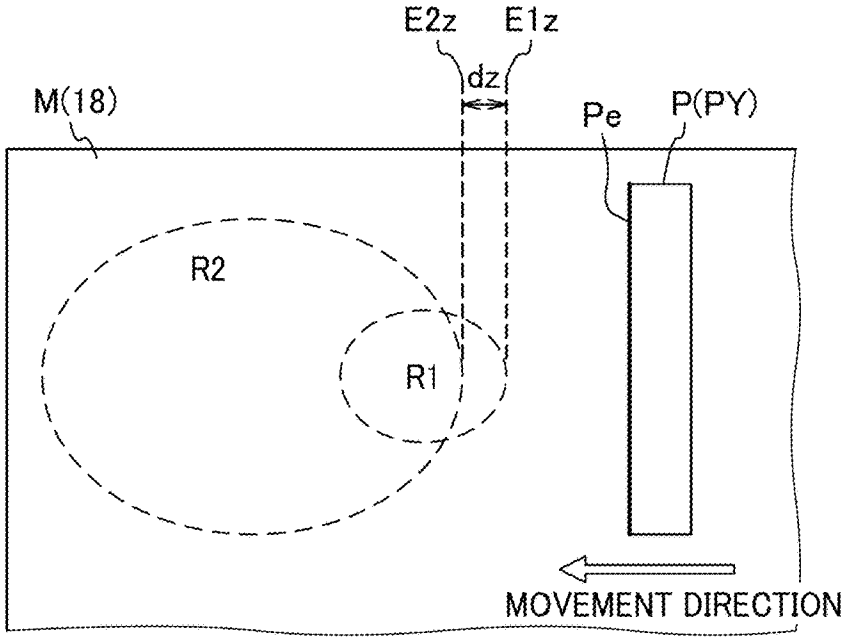
Figure 6C:
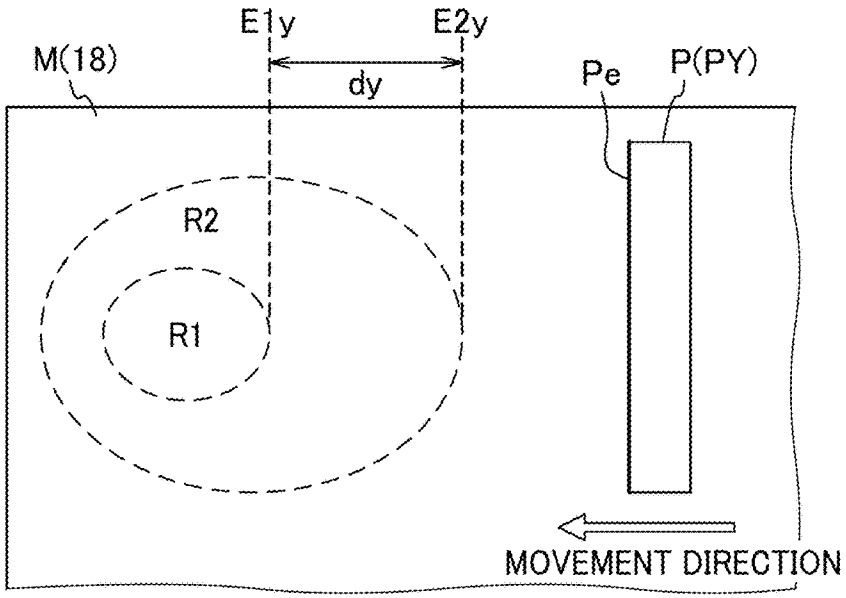
Figure 6E:
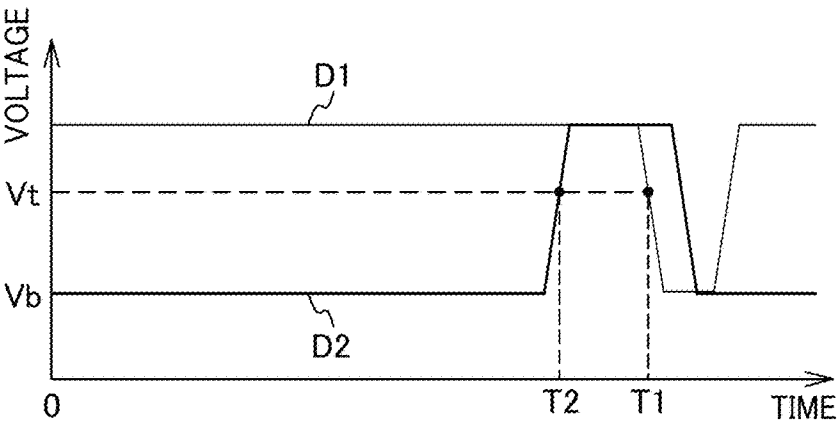

FIG. 6C and FIG. 6E are diagrams illustrating another example case in the tilt correction mode. In the examples of FIG. 5A and FIG. 5B, the installation angle of the photosensor 40 is not shifted from the reference angle. In the examples of FIG. 6C and FIG. 6E, the installation angle of the photosensor 40 is shifted from the reference angle in the first rotation direction by the tilt θ, in substantially the same manner as the example of FIG. 6A.

In FIG. 6C, a part of the image bearing surface M in the tilt correction mode is illustrated, and the outer edge (field-of-view diameter) of the detection region R (1, 2) of the photosensor 40 is indicated by a broken line, in substantially the same manner as the example of FIG. 5A described above.

In the present embodiment, for ease of explanation, the end E1 (the end on the opposite side of the movement direction of the first detection region R1) under a condition where the installation angle of the photosensor 40 is shifted from the reference angle in the first rotation direction may be referred to as an end E1*y*. In addition, the end E2 (the end portion on the opposite side in the movement direction of the second detection region R2) under a condition where the installation angle of the photosensor 40 is shifted from the reference angle in the first rotation direction may be referred to as an end E2*y*. As illustrated in FIG. 6C, a distance between the end E1*y* and the end E2*y* in the movement direction is a distance dy.

When the installation angle of the photosensor 40 is shifted from the reference angle, a position of the first detection region R1 (field-of-view diameter of the first light receiving element 42) in the movement direction changes. In addition, a position of the second detection region R2 in the movement direction (field-of-view diameter of the second light receiving element 43) changes. In the above-described case, a positional relationship between the first detection region R1 and the second detection region R2 in the movement direction changes.

For example, in the present embodiment, a state of the photosensor 40 is changed from a state in which the installation angle is same as the reference angle to a state in which the installation angle of the photosensor 40 is shifted from the reference angle by the tilt θ in the first rotation direction (a state illustrated in FIG. 2B to a state illustrated in FIG. 6A). In the above-described case, as illustrated in FIG. 6C, the distance between the end E1 of the first detection region R1 and the end E2 of the second detection region R2 increases. In other words, the distance dx (see FIG. 5A) is changed to the distance dy.

In addition, as illustrated in FIG. 6C, when the photosensor 40 rotates in the first rotation direction, the end E2*y* of the second detection region R2 is closer to an opposite side of the movement direction (upstream side) than the end E1*y* of the first detection region R1. With the above-described configuration, the correction pattern P (yellow image PY) is detected in the second detection region R2 before being detected in the first detection region R1. Accordingly, the second detected information (signal) D2 changes to the threshold voltage Vt before the first detected information (signal) D1 does so. That is, the first time point t1 comes after the second time point t2.

When the positional relationship between the first detection region R1 and the second detection region R2 in the movement direction changes, a phase difference between the detected information D1 and the second detected information D2 changes. A more detailed description is given later with reference to FIGS. 6E and 6F. That is, the time difference information A, which indicates a difference between the time T1 indicating a time to when the first detected information D1 reaches the threshold voltage Vt and the time T2 indicating a time to when the second detected information D2 reaches the threshold voltage Vt, changes.

FIG. 6E is a diagram illustrating change in time related to the first detected information D1 and the second detected information D2, in substantially the same manner as FIG. 5B. In the example of FIG. 5B, the installation angle of the photosensor 40 is the reference angle. On the other hand, in the example of FIG. 6E, the installation angle of the photosensor 40 is shifted from the reference angle in the first rotation direction.

In the example of FIG. 6E described above, a phase difference between the first detected information D1 and the second detected information D2 is larger than the phase difference in the example of FIG. 5B in which the installation angle of the photosensor 40 is the reference angle. In addition, in the example of FIG. 6E, the first time point t1 at which the first detected information D1 reaches the threshold voltage Vt (the end time point of the time T1) comes after the second time point t2 at which the second detected information D2 reaches the threshold voltage Vt (the end time point of the time T2). Accordingly, the time difference information A (=T1−T2) is a positive numerical value.

FIG. 6B is a diagram illustrating another example in which the installation angle of the photosensor 40 is shifted from the reference angle. FIG. 6B is a cross-sectional view illustrating the photosensor 40 when the photosensor 40 is cut in the movement direction, in substantially the same manner as the example in FIG. 6A.

As described above, in the example of FIG. 6A, the photosensor 40 rotates in the first rotation direction. On the other hand, in the example of FIG. 6B, the photosensor 40 is rotates in a direction indicated by an arrow B, which is, hereinafter referred to as a "second rotation direction". When the photosensor 40 rotates in the second rotation direction from the reference angle, the first time point t1, at which the first detected information D1 reaches the threshold voltage Vt, comes before the second time point t2, at which the second detected information D2 reaches the threshold voltage Vt. A more detailed description is given below.

Figure 6F:
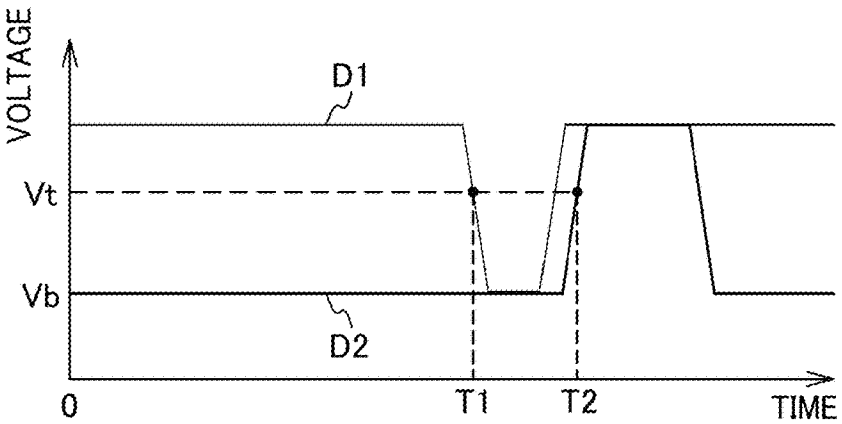

FIG. 6D and FIG. 6F are diagrams illustrating another example case in the tilt correction mode, according to an embodiment. In the examples of FIG. 6D and FIG. 6F, the installation angle of the photosensor 40 is shifted from the reference angle in the second rotation direction by the tilt θ, in substantially the same manner as the example of FIG. 6B.

In FIG. 6D, a part of the image bearing surface M in the tilt correction mode is illustrated, and the outer edge (field-of-view diameter) of the detection region R (1, 2) of the photosensor 40 is indicated by a broken line, in substantially the same manner as the example of FIG. 5A and FIG. 6C.

In the present embodiment, for ease of explanation, the end E1 (the end on the opposite side of the movement direction of the first detection region R1) under a condition where the installation angle of the photosensor 40 is shifted from the reference angle in the second rotation direction may be referred to as an end E1*z*. In addition, the end E2 (the end portion on the opposite side in the movement direction of the second detection region R2) under a condition where the installation angle of the photosensor 40 is shifted from the reference angle in the second rotation direction may be referred to as an end E2*z*. A distance between the end E1*z* and the end E2*z* in the movement direction is a distance dz. The distance dz changes according to the tilt θ (in substantially the same manner as the distance dy).

As illustrated in FIG. 6D, when the photosensor 40 rotates in the second rotation direction, the end E2 of the second detection region R2 moves to the side of the movement direction (downstream side). In addition, as illustrated in FIG. 6D, when the photosensor 40 rotates in the second rotation direction, the end E2z of the second detection region R2 is closer to the side of the movement direction than the end E1z of the first detection region R1.

With the above-described configuration, when the photosensor 40 rotates in the second rotation direction, the correction pattern P (yellow image PY) is detected in the first detection region R1 and then detected in the second detection region R2 in the tilt correction mode. Accordingly, the second detected information (signal) D2 changes to the threshold voltage Vt before the first detected information (signal) D1 does so. That is, the first time point t1 comes before the second time point t2.

FIG. 6F is a diagram illustrating change in time related to the first detected information D1 and the second detected information D2, in substantially the same manner as FIG. 5B and FIG. 6E. In the example of FIG. 6F, the installation angle of the photosensor 40 is shifted from the reference angle in the second rotation direction.

In the example of FIG. 6E described above, a phase difference between the first detected information D1 and the second detected information D2 is larger than the phase difference in the example of FIG. 5B in which the installation angle of the photosensor 40 is the reference angle. In addition, in the example of FIG. 6F, the first time point t1 at which the first detected information D1 reaches the threshold voltage Vt (the end time point of time T1) comes before the second time point t2 at which the first detected information D1 reaches the threshold voltage Vt (the end time point of time T2). Accordingly, the time difference information A (=T1−T2) is a negative numerical value.

As described above, the time difference information A changes according to the difference (tilt θ) between the installation angle of the photosensor 40 and the reference angle. The tilt θ and the time difference information A have a certain relationship. Due to the relationship, the tilt θ is identifiable (to be estimated) based on the time difference information A. The image forming apparatus 100 (the tilt information table storage unit 105) according to the present embodiment stores a tilt information table in which the tilt information B and the time difference information A are associated with each other in advance based on the relationship.

In addition, as described above, the time difference information table includes the first time difference information table Ja and the second time difference information table Jb. When the difference between the first time point t1 and the second time point t2 is a positive numerical value, the tilt information B is determined by the first time difference information table Ja. That is, when the photosensor 40 is tilted in the first rotation direction, the tilt information B indicating the tilt θ (see FIG. 6A described above) is determined based on the first time difference information table Ja.

On the other hand, when the difference between the first time point t1 and the second time point t2 is a negative numerical value, the tilt information B is determined by the first time difference information table Jb. That is, when the photosensor 40 is tilted in the second rotation direction, the tilt information B indicating the tilt θ (see FIG. 6B described above) is determined by the second time difference information table Jb. With the configuration described above, the tilt information B indicating the difference between the installation angle of the photosensor 40 and the reference angle (tilt θ) is to be determined, no matter whether the photosensor 40 is tilted in the first rotation direction or the second rotation direction.

FIG. 7A is a conceptual diagram illustrating the first tilt information table Ja, according to the present embodiment. The first tilt information table Ja is used when the time difference information A is a positive numerical value (including the numerical value of "0"), and includes the time difference information A and the tilt information B corresponding to the time difference information A.

For example, the tilt θ of the photosensor 40 is nearly 0 degree (installation angle=reference angle=90 degrees). In the photosensor 40 according to the present embodiment in the above-described case, the difference between the time T1 indicating a time to when the first detected information D1 reaches the threshold voltage Vt and the time T2 indicating a time to when the second detected information D2 reaches the threshold voltage Vt is approximately 2.2 milliseconds. In consideration of the condition described above, in the present embodiment, when the time difference information A (T1−T2) is in a range of "0≤A<2.95", which includes the numerical value of "2.2", the tilt information indicating that the tilt θ is nearly 0 degree is determined.

Further, it is assumed that the photosensor 40 is shifted from the reference angle in the first rotation direction by approximately 1 degree (θ nearly equal (≈) to 1 degree). In the photosensor 40 according to the present embodiment in the above-described case, the difference between the time T1 indicating a time to when the first detected information D1 reaches the threshold voltage Vt and the time T2 indicating a time to when the second detected information D2 reaches the threshold voltage Vt is approximately 3.7 milliseconds. In consideration of the condition described above, when the time difference information A (T1−T2) is in a range of "2.95≤A<4.45" (including the numerical value of "3.7"), the tilt information of "1" indicating that the photosensor 40 is shifted from the reference angle by approximately 1 degree in the first rotation direction is determined.

Further, it is assumed that the photosensor 40 is shifted from the reference angle in the first rotation direction by approximately 2 degree (θ nearly equal (≈) to 2 degree). In the photosensor 40 according to the present embodiment in the above-described case, the difference between the time T1 indicating a time to when the first detected information D1 reaches the threshold voltage Vt and the time T2 indicating a time to when the second detected information D2 reaches the threshold voltage Vt is approximately 5.2 milliseconds. In consideration of the condition described above, when the time difference information A (T1−T2) is in a range of "4.45≤A<5.95" (including the numerical value of "5.2"), the tilt information of "2" indicating that the photosensor 40 is shifted from the reference angle by approximately 2 degree in the first rotation direction is determined.

Similarly, when the photosensor 40 is shifted from the reference angle in the first rotation direction by approximately 3 degrees, the difference between the time T1 and the time T2 is approximately 6.7 milliseconds, in the photosensor 40 according to the present embodiment. In consideration of the condition described above, when the time difference information A is in a range of "5.95≤A<7.45" (including the numerical value of "6.7"), the tilt information of "3" indicating that the photosensor 40 is shifted from the reference angle by approximately 3 degree in the first rotation direction is determined.

Similarly, when the photosensor 40 is shifted from the reference angle in the first rotation direction by approximately 4 degrees, the difference between the time T1 and the time T2 is approximately 8.2 milliseconds, in the photosensor 40 according to the present embodiment. In consideration of the condition described above, when the time difference information A is in a range of "7.45≤A<8.95" (including the numerical value of "8.2"), the tilt information of "4" indicating that the photosensor 40 is shifted from the reference angle by approximately 4 degree in the first rotation direction is determined.

Similarly, when the photosensor 40 is shifted from the reference angle in the first rotation direction by approximately 5 degrees, the difference between the time T1 and the time T2 is approximately 9.7 milliseconds, in the photosensor 40 according to the present embodiment. In consideration of the condition described above, when the time difference information A is in a range of "8.95≤A<10.45" (including the numerical value of "9.7"), the tilt information of "5" indicating that the photosensor 40 is shifted from the reference angle by approximately 5 degree in the first rotation direction is determined.

FIG. 7B is a conceptual diagram illustrating the second tilt information table Jb, according to the present embodiment. The second tilt information table Jb is used when the time difference information A is a negative numerical value, and includes the time difference information A and the tilt information B corresponding to the time difference information A.

For example, it is assumed that the photosensor 40 is shifted from the reference angle in the second rotation direction by approximately 1 degree (θ nearly equal (≈) to −1 degree). In the photosensor 40 according to the present embodiment in the above-described case, the difference between the time T1 indicating a time to when the first detected information D1 reaches the threshold voltage Vt and the time T2 indicating a time to when the second detected information D2 reaches the threshold voltage Vt is approximately −3.7 milliseconds. In consideration of the condition described above, when the time difference information A (T1−T2) is in a range of "−2.95>A≥−4.45" (including the numerical value of "−3.7"), the tilt information of "−1" indicating that the photosensor 40 is shifted from the reference angle by approximately 1 degree in the second rotation direction is determined.

Similarly, when the time difference information A (T1−T2) is in a range of "−4.45>A≥−5.95", the tilt information of "−2" indicating that the photosensor 40 is shifted from the reference angle by approximately 2 degrees in the second rotation direction is determined. In addition, when the time difference information A is in a range of "−5.95>A≥−7.45", the tilt information of "−3" indicating that the photosensor 40 is shifted from the reference angle by approximately 3 degrees in the second rotation direction is determined. In addition, when the time difference information A is in a range of "−7.45>A≥−8.95", the tilt information of "−4" indicating that the photosensor 40 is shifted from the reference angle by approximately 4 degrees in the second rotation direction is determined. In addition, when the time difference information A is in a range of "−8.95>A≥−10.45", the tilt information of "−5" indicating that the photosensor 40 is shifted from the reference angle by approximately 5 degrees in the second rotation direction is determined.

The tilt information other than the numerical value of "−5 to 5" may be determined in the configuration according to an embodiment. Further, the time difference information A and the tilt information B are appropriately set in consideration of a moving speed of the correction pattern P in the tilt correction mode, a structure of the photosensor 40, or the like. As described above, the image forming apparatus 100 notifies the tilt information determined by the tilt information determination unit 106.

A manner to notify the tilt information B may be changed appropriately. For example, the tilt information B may be directly displayed. In the above-described configuration, the number "1" is displayed when the tilt information B is "1", and the number "−1" is displayed when the tilt information B is "−1". Alternatively, a message may be displayed. For example, when the tilt information B is "1", a message indicating "The shift is about 1 degree in the first rotation direction" may be displayed, and when the tilt information B is "−1", a message indicating "The shift is about 1 degree in the second rotation direction" may be displayed.

According to the embodiment described above, a user is allowed to adjust the installation angle of the photosensor 40 by an angle indicated by the tilt information B notified and change the current installation angle of the photosensor 40 to the reference angle. Therefore, the installation angle of the photosensor 40 is easily adjusted as compared with a configuration in which the tilt information B is not determined.

In addition, the tilt information B according to the present embodiment is obtained and stored in advance based on the relationship between the tilt θ of the photosensor 40 and the time difference information A. Accordingly, a calculation process required to determine the tilt information B in the correction mode (for example, the process of subtracting the time T2 from the time T1) is simple, and an amount of processing until the tilt information B is determined is reduced.

In the present embodiment, the threshold voltage Vt for storing the time T1 and the threshold voltage Vt for storing the time T2 are the same. However, the threshold voltage Vt for storing the time T1 and the threshold voltage Vt for storing the time T2 may be different from each other. The difference between the installation angle of the photosensor 40 and the reference angle is identifiable (to be estimated) based on the time difference information A generated with the above-described configuration. In the above-described configuration, similarly to the present embodiment, the tilt information B, which indicates the difference between the installation angle and the reference angle, identified based on the time difference information A is stored in association with the time difference information A.

Figure 8A:
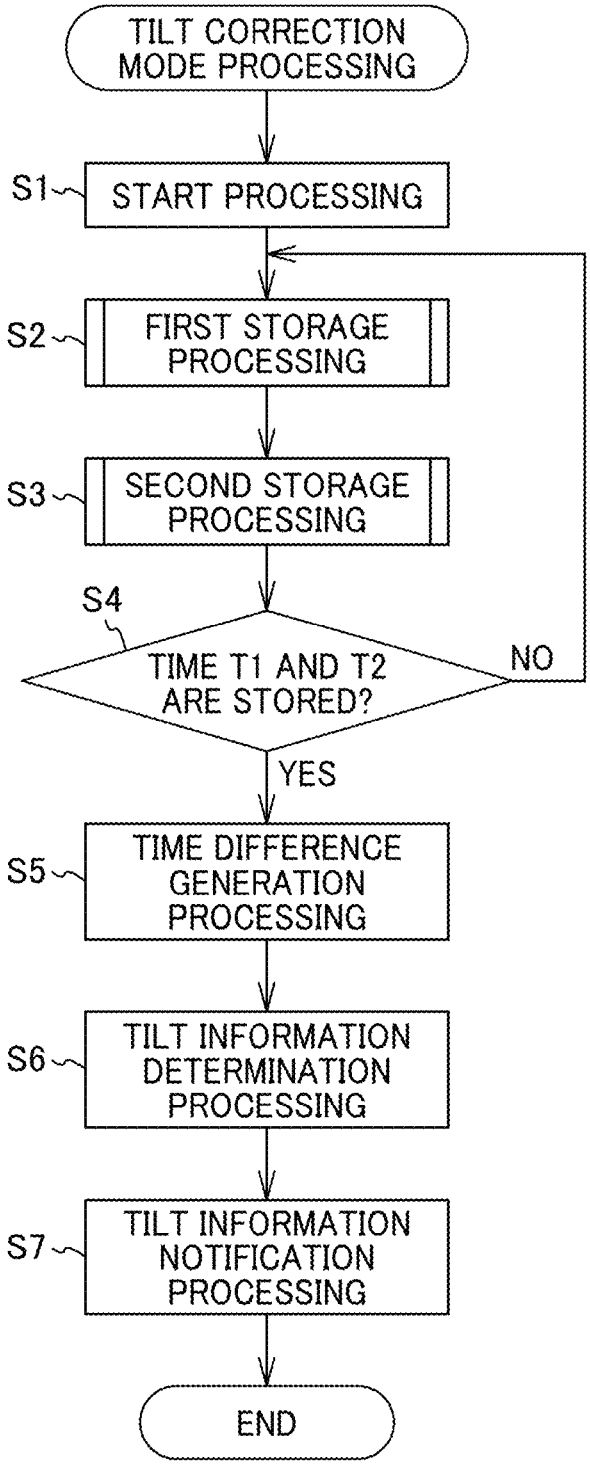
FIG. 8A is a flowchart illustrating processing in a tilt correction mode, according to one of the embodiments.

FIG. 8A is a flowchart illustrating processing in the tilt correction mode processing, according to the present embodiment. Hereinafter, the processing may be referred to as tilt correction mode processing. The image forming apparatus 100 (CPU 201) starts the tilt correction mode processing when shifting to the tilt correction mode.

When the tilt correction mode processing is started, the image forming apparatus 100 executes start processing (S1). In the start processing, the correction pattern P is formed on the image bearing surface M (transfer belt 18), and then the correction pattern P starts moving. As described above, the correction pattern P moves at the predetermined specific speed. In addition, when the movement of the correction pattern P starts, the timer starts updating. The timer is used to measure the time T (1, 2) that indicates a period of time to when the detected information D (1, 2) reaches the threshold voltage Vt.

The image forming apparatus 100 performs first storage processing (S2) after executing the start processing. In the first storage processing, when the first detected information D1 reaches the threshold voltage Vt, the time T1 is stored (for details, see FIG. 8B described later). In addition, the image forming apparatus 100 executes second storage processing (S3) after executing the first storage process. In the second storage processing, the time T2 is stored when the second detected information D2 reaches the threshold voltage Vt (for details, see FIG. 8C described later).

After executing the second storage processing, the image forming apparatus 100 determines whether both the time T1 and the time T2 are stored (S4). When either one of the time T1 and the time T2 is stored, or neither the time T1 nor the time T2 is stored (S4: No), the image forming apparatus 100 repeats executing the first storage processing and the second storage processing. On the other hand, when both the time T1 and the time T2 are stored (S4: YES), the image forming apparatus 100 proceeds processing to the time difference information generation processing (S5).

In the time difference information generation processing, the time difference information A is generated. Specifically, in the time difference information generation processing, the image forming apparatus 100 subtracts the time T2 stored in step S3 from the time T1 stored in step S2, and stores a subtraction result as the time difference information A (T1−T2=A).

After executing the time difference information generation processing, the image forming apparatus 100 executes tilt information determination processing (S6). In the tilt information determination processing, the tilt information B is determined. In the tilt information determination processing, the tilt information B corresponding to the time difference information A, which is generated in the time difference information generation processing, is determined using the tilt information table (see FIG. 7A and FIG. 7B described above).

Specifically, when starting the tilt information determination processing, the image forming apparatus 100 determines whether the time difference information A is a positive numerical value (including the numerical value "0"). When determining that the time difference information A is a positive numerical value (including the numerical value "0"), the image forming apparatus 100 determines the tilt information B using the tilt information table Ja. The image forming apparatus 100 determines the tilt information B corresponding to the time difference information A, which is generated in step S5 described above, based on the tilt information table Ja.

In addition, when determining that the time difference information A is a negative numerical value, the image forming apparatus 100 determines the tilt information B using the tilt information table Jb. Specifically, the tilt information B corresponding to the time difference information A, which is generated in step S5 described above, is determined based on the tilt information table Jb. In the present embodiment described above, the tilt information B is appropriately determined even when the time difference information A is a negative numerical value.

After executing the tilt information determination processing, the image forming apparatus 100 executes the tilt information notification processing (S7). In the tilt information notification processing, the image forming apparatus 100 notifies the tilt information B determined in the tilt information determination processing described above. Specifically, the tilt information B determined by the tilt information determination processing is displayed on the panel display 240*a*. For example, when an operation is performed on the panel display 240*a*, the image forming apparatus 100 hides the tilt information B and ends the tilt correction mode processing.

Figure 8B:
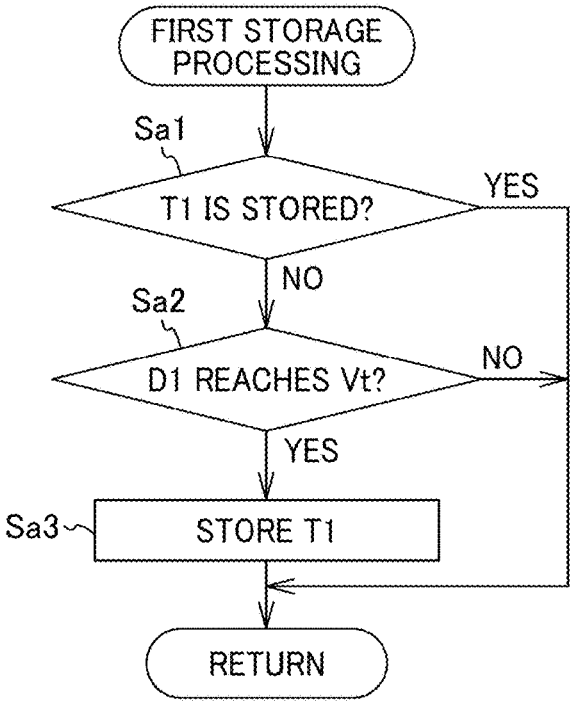
FIG. 8B is a flowchart illustrating first storage processing, according to one of the embodiments.

FIG. 8B is a flowchart illustrating the first storage processing (S2 of FIG. 8A), according to the present embodiment. When starting the first storage processing, the image forming apparatus 100 determines whether the time T1 has been stored or not (Sa1). When determining that the time T1 has been stored (Sa1: YES), the image forming apparatus 100 ends the first storage processing. On the other hand, when determining that the time T1 is not stored (Sa1: NO), the image forming apparatus 100 determines whether the first detected information (signal) D1 reaches the threshold voltage Vt (Sa2).

When determining that the first detected information D1 has reached the threshold voltage Vt (Sa2: YES), the image forming apparatus 100 stores a current value of the timer as the time T1 (Sa3), and ends the first storage processing. On the other hand, when determining that the first detected information D1 has not reached the threshold voltage Vt (Sa2: NO), the image forming apparatus 100 ends the first storage processing without storing the time T1.

Figure 8C:
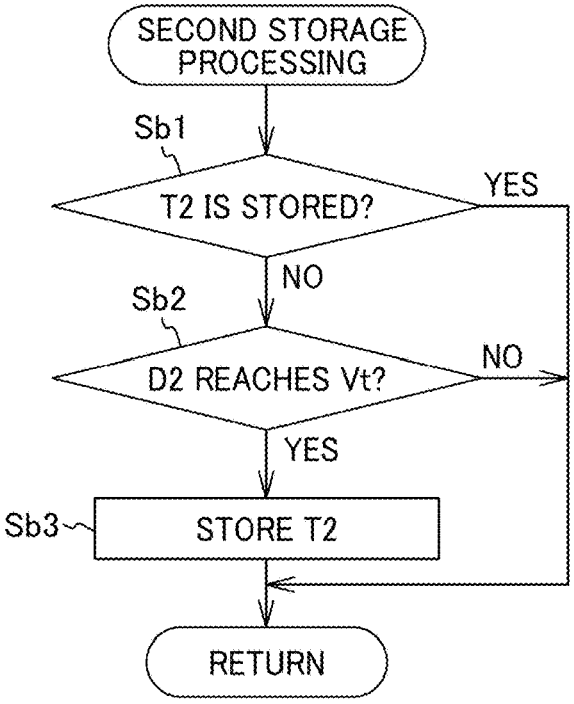
FIG. 8C is a flowchart illustrating second storage processing, according to one of the embodiments.

FIG. 8C is a flowchart illustrating the second storage processing (S3 in FIG. 8A), according to the present embodiment. When starting the second storage processing, the image forming apparatus 100 determines whether the time T2 has been stored (Sb1). When determining that the time T2 has been stored (Sb1: YES), the image forming apparatus 100 ends the second storage processing. On the other hand, when determining that the time T2 is not stored (Sb1: NO), the image forming apparatus 100 determines whether the second detected information (signal) D2 has reached the threshold voltage Vt (Sb2).

When determining that the second detected information D2 has reached the threshold voltage Vt (Sb2: YES), the image forming apparatus 100 stores a current value of the timer as the time T2 (Sb3), and ends the second storage processing. On the other hand, when determining that the second detected information D2 has not reached the threshold voltage Vt (Sb2: NO), the image forming apparatus 100 ends the second storage processing without storing the time T2.

Second Embodiment

Other embodiments of the present disclosure are described below. Note that, in the embodiments described below, elements having the same function as the elements described in the first embodiment is denoted by the reference numeral used in the description of the first embodiment, and detailed description thereof is appropriately omitted.

In the first embodiment, the time difference information A is generated one time when the specific image (yellow image PY) moves to the detection region (R1 and R2 in FIG. 5A). In other words the time difference information A is configured by a piece of information in the first embodiment. In the second embodiment, a plurality of pieces of time difference information A are generated. In addition, in the second embodiment, an average value of the plurality pieces of time difference information A is obtained, and the tilt information B corresponding to the average value is determined.

Specifically, in the tilt correction mode in the second embodiment, a plurality of yellow images PY are formed in the movement direction of the image bearing surface M. The yellow images PY sequentially move to the detection region R of the photosensor 40 one by one in the tilt correction mode (sequentially detected by the photosensor 40). The image forming apparatus 100 according to the second embodiment generates the time difference information A each time when the yellow image PY enters the detection region R.

For example, it is assumed that n (n is an integer of 2 or more) yellow images PY are detected, in the tilt correction mode, by the photosensor 40. In the above case, n pieces of time difference information A are generated. The image forming apparatus 100 obtains the average value of the n pieces of time difference information A. Hereinafter, the average value is referred to as "time difference information Aa".

The image forming apparatus 100 determines the tilt information B corresponding to the time difference information Aa using the tilt information table. Specifically, when the time difference information Aa is a positive numerical value, the tilt information B is determined by using the tilt information table Ja. When the time difference information Aa is a negative numerical value, the tilt information B is determined by using the above tilt information table Jb.

In the second embodiment, the same effect as in the first embodiment described above is obtained. In addition, in the second embodiment, the average value of the plurality pieces of time difference information A is obtained. In the second embodiment, for example, the difference from the original time difference information A is reduced as compared with the configuration in which the time difference information A is generated one time. Accordingly, a difference between the tilt information B, which is actually determined, and the original tilt information B is reduced.

The embodiments described above are examples, and aspects of the present disclosure attain effects and advantages as described below.

First Aspect

The image forming apparatus 100 according to a first aspect includes the image forming unit 101 (image forming device that includes the engine controller 230, the photoconductor drums 14, or the like) that forms various images including a specific image, the image bearing unit (the transfer belt 18) with which an image bearing surface M bearing the image formed by the image forming unit 101 is provided, the moving unit (the image moving unit 102) that moves the specific image to a first detection region R1 and a second detection region R2 on the image bearing surface M, the light emitting element 41 that emits detected light to the image bearing surface M, the first light receiving element 42 that receives detected light reflected from the first detection region R1, and the second light receiving element 43 that receives detected light reflected from the second detection region R2. The image forming apparatus 100 according to the first aspect further includes the sensor (the photosensor 40) that is installed at an installation angle with respect to the image bearing surface M, and the detected information generation unit 103 that generates detected information including first detected information D1 according to a first quantity of detected light entering the first light receiving element 42 and second detected information D2 according to a second quantity of detected light entering the second light receiving element 43. The image forming apparatus 100 according to the first aspect further includes a time difference information generation unit 104 that generates time difference information A according to a difference between a first time point t1 at which the first detected information reaches a threshold value and a second time point t2 at which the second detected information reaches the threshold value, when the specific image on the image bearing surface moves, a tilt information table storage unit 105 that stores a plurality of tilt information tables Ja and Jb in each of which tilt information B indicating a difference between the installation angle and a reference angle is associated with the time difference information A, and the tilt information determination unit 106 that determines tilt information which is corresponding to the time difference information, using one of the plurality of tilt information tables. The one of the plurality of tilt information tables to be used is determined by the time difference information. According to the first aspect described above, the adjustment of the sensor is facilitated.

Second Aspect

In the image forming apparatus 100 according to a second aspect, the tilt information determination unit 106 uses a first tilt information table when the first time point is after the second time point, and uses a second tilt information table when the first time point is before the second time point. According to the present aspect, both when the sensor (the photosensor 40) is deviated in a manner that the first time point is after the second time point and when the sensor is deviated in a manner that the first time point is before the second time point, the tilt information is determined.

Third Aspect

The image forming apparatus 100 according to a third aspect includes the density correction unit 111 capable of correcting density of an image formed by the image forming unit 101, or the image forming device, based on the detected information. According to the present aspect, the sensor (the photosensor 40) is used in common for correcting the density of the image and for generating the time difference information.

Fourth Aspect

The image forming apparatus 100 according to a third aspect includes the light quantity adjustment unit 112 that adjusts a quantity of light emitted from the light emitting element 41 in a manner that the quantity of light becomes larger when the detected information for generating the time difference information is generated, than when the density correction unit 111 generates the detected information for correcting the density of an image is generated. With the configuration described above, the image forming apparatus 100 reduces difference in the time difference information by making the detected information for generating the time difference information be a rectangular wave, while the density correction unit 111 maintains a suitable magnitude of the detected information to correct the density of the image.

Fifth Aspect

A control method is performed by the image forming apparatus 100 according to a fifth aspect. The image forming apparatus according to the fifth aspect includes image bearing unit having an image bearing surface M on which various images are formed, the light emitting element 41 that emits detected light to the image bearing surface M, the first light receiving element 42 that receives detected light reflected from a first detection region R1, the second light receiving element 43 that receives detected light reflected from a second detection region R2, and the sensor (the photosensor 40) installed at an installation angle with respect to the image bearing surface M. The control method further includes, using the sensor, generating detected information including a first detected information D1 generated according to a first quantity of light that enters the first light receiving element 42 and the second detected information D2 generated according to a second quantity of light that enters the second light receiving element 43, forming a specific image on the image bearing surface M, moving the specific image to a first detection region R1 and a second detection region R2, generating time difference information according to a time difference between a first time point t1 that is a time point at which the first detected information D1 reaches a threshold value and a second time point t2 that is a time point at which the second detected information D2 reaches the threshold value, and determining tilt information corresponding to the time difference information, using one of a plurality of tilt information tables in each of which tilt information indicating a difference between the installation angle and a reference angle is associated with the time difference information. With the control method according to the fifth aspect, the same effect as in the first embodiment is obtained.

Sixth Aspect

A program according to a sixth aspect causes a computer to execute each step in the control method according to the fifth embodiment. With the program according to the sixth aspect, the same effect as in the first embodiment is obtained.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

Although the embodiments of the disclosure have been described and illustrated above, such description is not intended to limit the disclosure to the illustrated embodiments. Numerous additional modifications and variations are possible in light of the above teachings. It is therefore to be understood that within the scope of the appended claims, the embodiments may be practiced otherwise than as specifically described herein. For example, elements and/or features of different illustrative embodiments may be combined with each other and/or substituted for each other within the scope of this disclosure and appended claims.

What is claimed is:

1. An image forming apparatus comprising:

an image forming device configured to form various images including a specific image;

a transfer belt having an image bearing surface on which the specific image is formed, the transfer belt being configured to move the specific image to a first detection region and a second detection region on the image bearing surface;

a sensor installed at an installation angle with respect to the image bearing surface, the sensor including a light emitting element emitting detected light to the image bearing surface, a first light receiving element receiving a first part of the detected light that is reflected from the first detection region, and a second light receiving element receiving a second part of the detected light that is reflected from the second detection region; and circuitry configured to generate detected information, the detected information including first detected information according to a quantity of light entered the first light receiving element and second detected information according to a quantity of light entered the second light receiving element, generate, when the specific image on the image bearing surface moves, time difference information according to a difference between a first time point and a second time point, the first time point being a time at which the first detected information tables reaches a threshold value and the second time point being a time at which the second detected information table reaches the threshold value, obtain, from a memory, one of a plurality of tilt information tables, the one of the plurality of tilt information being determined based on the time difference information that is generated, each tilt information associating tilt information indicating a difference between the installation angle and a reference angle, with time difference information, and determine tilt information corresponding to the time difference information that is generated, using the one of the plurality of tilt information tables that is obtained.

2. The image forming apparatus of claim 1, wherein the circuitry uses a first tilt information table of the plurality of tilt information tables when the first time point is after the second time point, and uses a second tilt information table of the plurality of tilt information tables when the first time point is before the second time point.

3. The image forming apparatus of claim 1, wherein the circuitry corrects density of the images based on the detected information.

4. The image forming apparatus of claim 3, wherein the circuitry adjusts a quantity of light emitted from the light emitting element in a manner that the quantity of light used when the detected information for generating the time difference information is generated is larger than the quantity of light used when the detected information for correcting the density of the image is generated.

5. A control method performed by an image forming apparatus, the method comprising:

forming an image on an image bearing surface, the image bearing surface having a first detection region and a second detection region;

using a sensor installed at an installation angle with respect to the image bearing surface, generating detected information including a first detected information and a second detected information based on detected light emitted from a light emitting element of the sensor, the first detected information being generated according to a first quantity of light that enters a first light receiving element of the sensor, the first light receiving element receiving a first part of the detected light that is reflected from the first detection region, the second detected information being generated according to a second quantity of light that enters a second light receiving element of the sensor, the second light receiving element receiving a second part of the detected light that is reflected from the second detection region;

moving the image to the first detection region and the second detection region on the image bearing surface;

generating time difference information according to a time difference between a first time point and a second time point, the first time point being a time at which the first detected information reaches a threshold value and a second time point being a time at which the second detected information reaches the threshold value; and determining tilt information corresponding to the time difference information, by using one of a plurality of tilt information tables in each of which the tilt information is associated with the time difference information, the tilt information indicating a difference between the installation angle and a reference angle.

6. A non-transitory recording medium storing a plurality of instructions which, when executed by one or more processors, cause the processors to perform a method, comprising:

forming an image on an image bearing surface, the image bearing surface having a first detection region and a second detection region;

using a sensor installed at an installation angle with respect to the image bearing surface, generating detected information including a first detected information and a second detected information based on detected light emitted from a light emitting element of the sensor, the first detected information being generated according to a first quantity of light that enters a first light receiving element of the sensor, the first light receiving element receiving a first part of the detected light that is reflected from the first detection region, the second detected information being generated according to a second quantity of light that enters a second light receiving element of the sensor, the second light receiving element receiving a second part of the detected light that is reflected from the second detection region;

moving the image to the first detection region and the second detection region on the image bearing surface;

generating time difference information according to a time difference between a first time point and a second time point, the first time point being a time at which the first detected information reaches a threshold value and a second time point being a time at which the second detected information reaches the threshold value; and determining tilt information corresponding to the time difference information, by using one of a plurality of tilt information tables in each of which the tilt information is associated with the time difference information, the tilt information indicating a difference between the installation angle and a reference angle.

* * * * *